US006568209B1

(12) United States Patent
Ziemer et al.

(10) Patent No.: US 6,568,209 B1
(45) Date of Patent: May 27, 2003

(54) CRYOGENIC AIR SEPARATION SYSTEM WITH DUAL SECTION MAIN HEAT EXCHANGER

(75) Inventors: John Harold Ziemer, Youngstown, NY (US); Anthony J. Kurek, Jr., Buffalo, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/235,713

(22) Filed: Sep. 6, 2002

(51) Int. Cl.[7] ..... F25J 3/00
(52) U.S. Cl. ..... 62/643; 62/644
(58) Field of Search ..... 62/643, 646, 620, 62/644, 903

(56) References Cited

U.S. PATENT DOCUMENTS 2,431,866 A * 12/1947 Dennis ..... 62/643
3,605,423 A * 9/1971 Stoklosinski ..... 62/643
4,594,085 A 6/1986 Cheung ..... 62/25
4,617,036 A 10/1986 Suchdeo et al. ..... 62/11
4,783,210 A 11/1988 Ayres et al. ..... 62/24
4,966,002 A 10/1990 Parker et al. ..... 62/31
5,144,809 A 9/1992 Chevalier et al. ..... 62/36
5,222,365 A 6/1993 Nenov ..... 62/39
5,228,298 A 7/1993 Kun et al. ..... 62/39
5,303,556 A 4/1994 Dray et al. ..... 62/24
6,237,366 B1 * 5/2001 Arman et al. ..... 62/643
6,295,836 B1 * 10/2001 Nguyen et al. ..... 62/643
6,295,839 B1 * 10/2001 Nguyen et al. ..... 62/643

* cited by examiner

*Primary Examiner*—William C. Doerrler
(74) *Attorney, Agent, or Firm*—Stanley Ktorides

(57) ABSTRACT

A cryogenic air separation system having a main heat exchanger for processing feed air, said heat exchanger having a reversing heat exchanger function in an upward feed airflow countercurrent section and having a desuperheating function in a downward feed air flow cocurrent section.

10 Claims, 1 Drawing Sheet

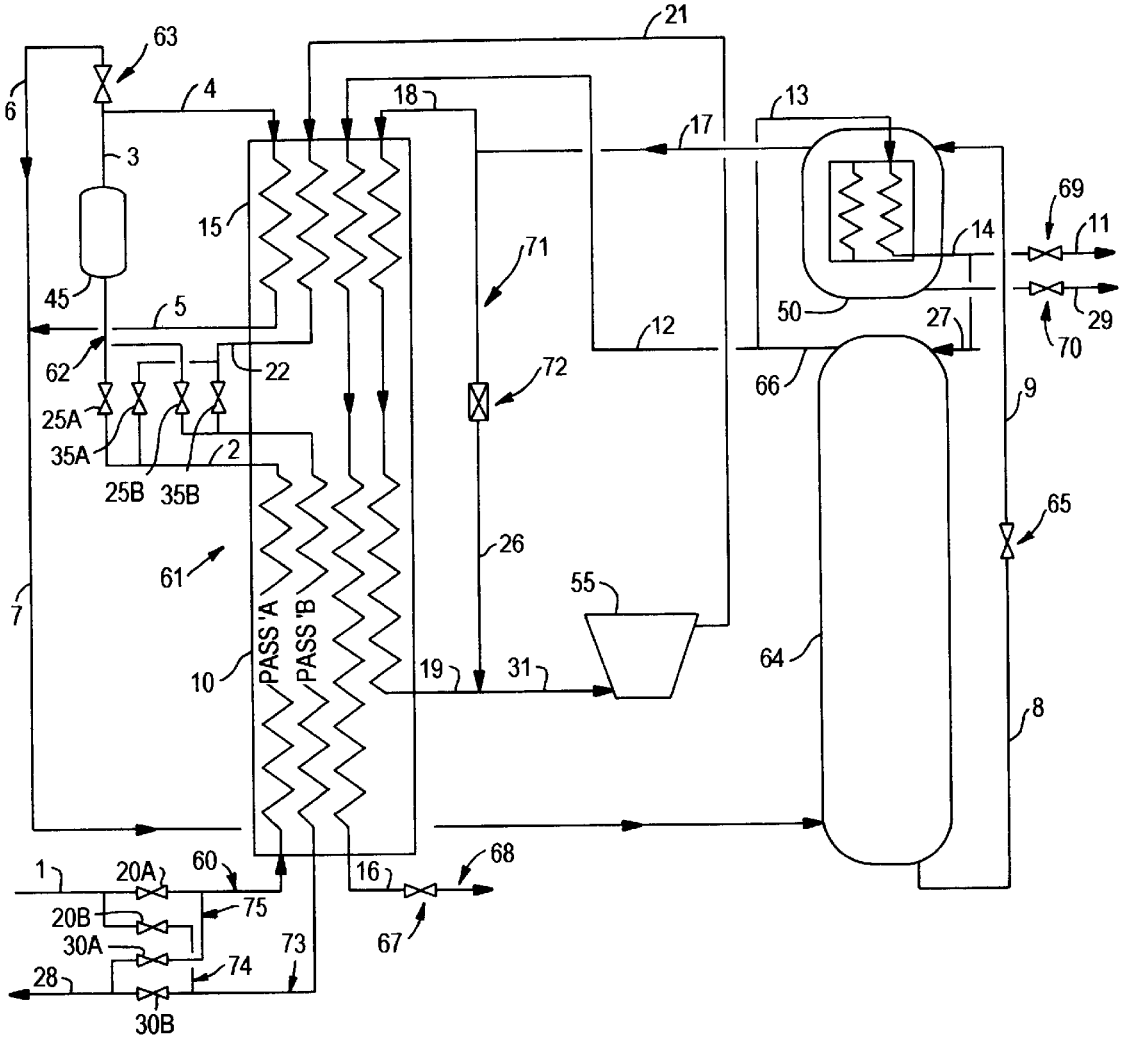
63
21
6
4
18
13
17
3
15
69
11
14
71
45
5
50
27
29
12
70
62
22
72
66
9
25A
35A
2
25B
35B
65
26
61
55
7
PASS 'A
PASS 'B
64
10
19
31
8
1
20A
60
16
68
20B
75
30A
73
67
74
28
30B

CRYOGENIC AIR SEPARATION SYSTEM WITH DUAL SECTION MAIN HEAT EXCHANGER

TECHNICAL FIELD

This invention relates generally to cryogenic air separation and, more particularly, to cryogenic air separation employing a reversing heat exchanger to clean and cool feed air prior to its passing into the cryogenic air separation plant.

BACKGROUND ART

In the practice of cryogenic air separation to produce one or more products such as nitrogen and oxygen, the feed air to the cryogenic air separation plant must be cleaned of high boiling impurities, such as carbon dioxide and water vapor, before it enters the cryogenic air separation plant because such high boiling impurities will freeze within the plant at the very low temperatures at which the plant operates, thus reducing the operating efficiency of the cryogenic air separation plant.

One very important system for cleaning the feed air is by the use of a reversing heat exchanger wherein the high boiling impurities freeze out onto the heat exchanger passages as the feed air is cooled against return streams such as product and waste streams, and periodically the flow of the feed air stream and a waste stream are alternated in the heat exchanger passages so that the deposited high boiling impurities are passed out of the heat exchanger with the waste stream.

Another important function in the operation of a cryogenic air separation system is the desuperheating of the compressed feed air before it enters the column(s) of the cryogenic air separation plant.

The heat exchangers employed to cool, clean and desuperheat the feed air for a cryogenic air separation plant involve considerable capital costs. Any improvement to such heat exchanger arrangement would be highly desirable.

Accordingly, it is an object of this to provide an improved heat exchanger system for treating feed air to a cryogenic air separation plant.

SUMMARY OF THE INVENTION

The above and other objects, which will become apparent to those skilled in the art upon a reading of this disclosure, are attained by the present invention, one aspect of which is:

A cryogenic air separation method comprising:

(A) cooling feed air by upward flow in a main heat exchanger to produce cooled feed air, and dividing the cooled feed air into a first portion and a second portion;

(B) partially condensing the first portion of the cooled feed air by downward flow in the main heat exchanger, and passing the partially condensed first portion of the cooled feed air and the second portion of the cooled feed air into a cryogenic air separation plant;

(C) separating the feed air by cryogenic rectification in the cryogenic air separation plant to produce at least one product; and (D) warming said at least one product by downward flow in the main heat exchanger, and recovering said at least one product.

Another aspect of the invention is:

Cryogenic air separation apparatus comprising:

(A) a main heat exchanger and a cryogenic air separation plant comprising at least one column;

(B) means for passing feed air upwardly through a first section of the main heat exchanger, and means for passing feed air downwardly through a second section of the main heat exchanger;

(C) means for passing feed air from the main heat exchanger to the cryogenic air separation plant; and (D) means for passing product from the cryogenic air separation plant to the main heat exchanger, and means for recovering product from the main heat exchanger.

As used herein, the term "feed air" means a mixture comprising primarily nitrogen and oxygen, such as ambient air.

As used herein, the terms "turboexpansion" and "turboexpander" mean respectively method and apparatus for the flow of high pressure fluid through a turbine to reduce the pressure and the temperature of the fluid thereby generating refrigeration.

As used herein, the term "column" means a distillation or fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, The Continuous Distillation Process.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the more volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of she vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluids into heat exchange relation without any physical contact or intermixing of the fluids with each other.

As used herein, the term "cryogenic air separation plant" means the column or columns wherein feed air is separated by cryogenic rectification, as well as interconnecting piping, valves, heat exchangers and the like.

As used herein, the terms "upper portion" and "lower portion" of a column means those portions respectively above and below the midpoint of the column.

As used herein, the term "top condenser" means a heat exchange device that generates column downflow liquid from column vapor.

As used herein, the term "product nitrogen" means a fluid having a nitrogen concentration equal to or greater than 99 mole percent.

BRIEF DESCRIPTION OF THE DRAWING

The sole FIGURE is a schematic representation of one preferred embodiment of the invention wherein the cryogenic air separation plant comprises a single column with a top condenser for producing product nitrogen.

DETAILED DESCRIPTION

In general the invention combines the reversing heat exchanger function in a countercurrent section of a vertically oriented main heat exchanger for treating feed air for a cryogenic air separation plant with the desuperheating function in a cocurrent section of the vertically oriented main heat exchanger.

The invention will be described in detail with reference to the Drawing. Referring now to the FIGURE, compressed feed air 1, generally at a pressure within the range of from 100 to 200 pounds per square inch absolute (psia), is passed through valve 20A and as stream 60 into pass A of vertically oriented main heat exchanger 61 which comprises a countercurrent or first section 10 and a cocurrent or second section 15. Countercurrent section 10 is at the lower end of vertically oriented main heat exchanger 61 and cocurrent section 15 is at the upper end of vertically oriented main heat exchanger 61.

The feed air is cooled by upward flow in countercurrent section 10 by countercurrent indirect heat exchange with return streams as will be more fully described below. High boiling impurities such as water vapor and carbon dioxide freeze out onto the inner surface of pass A as the cooling feed air passes upwardly in countercurrent section 10. The resulting cooled feed air is withdrawn from main heat exchanger 61 in cooled feed air stream 2 which is passed through valve 25A and as stream 62 to gel trap 45 wherein it is further cleaned of any residual contaminants down to trace levels.

The cooled feed air in stream 3 emerging from gel trap 45 is divided into first portion 4 and second portion 6. First portion 4 generally comprises from 3 to 20 percent, preferably from 5 to 15 percent, of the cooled feed air, and second portion 6 generally comprises the remainder of the cooled feed air, i.e. from 80 to 97 percent, preferably from 85 to 95 percent, of stream 3. First portion 4 is passed to main heat exchanger 61 and is cooled and partially condensed by downward flow through cocurrent section 15 by cocurrent indirect heat exchange with return streams as will be more fully described below, thereby serving to desuperheat the feed air. The partially condensed feed air first portion is withdrawn from main heat exchanger 61 in stream 5. Generally stream 5 comprises from about 20 to 90 percent liquid and from about 80 to 10 percent vapor, preferably from 30 to 70 percent liquid and from 70 to 30 percent vapor, most preferably from 40 to 60 percent liquid and from 60 to 40 percent vapor. In a particularly preferred embodiment, the partially condensed feed air first portion comprises about 55 percent liquid and about 45 percent vapor. Partially condensed feed air first portion 5 is combined with cooled feed air second portion 6, which has been passed through valve 63, to form combined feed air stream 7 for passage into the cryogenic air separation plant. Alternatively the first and second portions of the feed air may be passed separately into the cryogenic air separation plant.

In the embodiment of the invention illustrated in the FIGURE, the cryogenic air separation plant comprises a single column 64 and a top condenser 50. The feed air is passed into the lower portion of column 64 of the cryogenic air separation plant. Column 64 is operating at a pressure generally within the range of from 90 to 190 psia. Within column 64 the feed air is separated by cryogenic rectification into nitrogen-enriched vapor and oxygen-enriched liquid.

Oxygen-enriched liquid is withdrawn from the lower portion of column 64 in stream 8, throttled through valve 65 and passed as stream 9 into top condenser 50. Nitrogen-enriched vapor is withdrawn from the upper portion of column 64 as stream 12. A portion 12 of stream 66 is warmed by downward flow through main heat exchanger 61 by cocurrent indirect heat exchange with the partially condensing first feed air portion and by countercurrent indirect heat exchange with the cooling feed air stream. The warmed nitrogen-enriched vapor is withdrawn from main heat exchanger 61 as stream 16, passed through valve 67 and recovered as product nitrogen in stream 68.

Another portion 13 of the nitrogen-enriched vapor 66 is passed into top condenser 50 wherein it is condensed by heat exchange with boiling oxygen-enriched liquid introduced into top condenser 50 in stream 9. Resulting nitrogen-enriched liquid is withdrawn from top condenser 50 in stream 14. Some or all of the nitrogen-enriched liquid is passed into the upper portion of column 64 as reflux. In the embodiment of the invention illustrated in the FIGURE a portion 27 of the nitrogen-enriched liquid is passed into column 64 as reflux, and another portion is passed through valve 69 and recovered as product nitrogen liquid in stream 11. A small portion of-the oxygen-enriched liquid provided into top condenser 50 is removed through valve 70 in stream 29 so as to remove contaminants that may accumulate in the condenser pool.

Oxygen-enriched vapor, generally comprising from about 25 to 40 mole percent oxygen, is withdrawn from top condenser 50 in stream 17 and is divided into stream 18 and stream 71. Stream 18 is warmed by downward flow cocurrent heat exchange against the partially condensing first portion of the feed air and then by countercurrent heat exchange with the cooling feed air in the countercurrent section of main heat exchanger 61. The warmed oxygen-enriched vapor stream is withdrawn from main heat exchanger 61 in stream 19. Stream 71 is passed through valve 72 and as stream 26 is combined with stream 19 to form oxygen-enriched vapor stream 31. Stream 31 is passed to turboexpander 55 wherein it is turboexpanded to generate refrigeration. Thereafter resulting refrigeration bearing turboexpanded stream 21 is passed from turboexpander 55 to main heat exchanger 61.

The turboexpanded oxygen-enriched vapor is warmed by downward flow through cocurrent section 15 by indirect cocurrent heat exchange with the partially condensing first feed air portion. Resulting warmed oxygen-enriched vapor 22 is passed through valve 35B and is then further warmed by downward flow in pass B through countercurrent section 10 by indirect countercurrent heat exchange with the cooling upwardly flowing feed air in pass A. Resulting further warmed oxygen-enriched vapor, which contains contaminants picked up by passage through pass B which were deposited there in a previous cycle, is then removed from main heat exchanger 61 in stream 73, passed through valve 30B and removed from the system as waste stream 28.

Periodically the flow of the feed air in pass A and the flow of the waste stream in pass B is reversed. In such periods, feed air 1 flosses through valve 20B and as stream 74 is passed into pass B of main heat exchanger 61 and then is passed through valve 25B for passage to gel trap 45. Simultaneously, warmed oxygen-enriched vapor 22 is passed through valve 35A and then through pass A wherein it is further warmed and picks up the contaminants deposited therein by the feed air which passed through pass A in the previous period. The resulting waste stream is removed from main heat exchanger 61 in stream 74, passed through valve 30A and removed from the system in stream 28.

Although the invention has been described in detail with reference to a certain preferred embodiment those skilled in the art will recognize that there are other embodiments of the invention within the spirit and the scope of the claims. For example, another expansion device such as a Joule-Thomson valve may be used in place of turboexpander 55. In addition liquid nitrogen may be added to the top condenser arid/or the column to help sustain the cryogenic rectification. Moreover, the internal passage configuration of stream 4 in cocurrent section 15 may be of the cocurrent cross-flow type instead of the simple cocurrent flow arrangement shown in the Drawing.

What is claimed is:

1. A cryogenic air separation method comprising:

(A) cooling feed air by upward flow in a main heat exchanger to produce cooled feed air, and dividing the cooled feed air into a first portion and a second portion;

(B) partially condensing the first portion of the cooled feed air by downward flow in the main heat exchanger, and passing the partially condensed first portion of the cooled feed air and the second portion of the cooled feed air into a cryogenic air separation plant;

(C) separating the feed air by cryogenic rectification in the cryogenic air separation plant to produce at least one product; and (D) warming said at least one product by downward flow in the main heat exchanger, and recovering said at least one product.

2. The method of claim 1 wherein the first portion comprises from 3 to 20 percent of the cooled feed air.

3. The method of claim 1 wherein the partially condensed first portion of the feed air comprises from 20 to 90 percent liquid.

4. The method of claim 1 wherein said at least one product comprises product nitrogen.

5. The method of claim 1 further comprising turboexpanding a waste stream taken from the cryogenic air separation plant, and warming the turboexpanded waste stream by downward flow in the main heat exchanger.

6. The method of claim 1 wherein the partially condensed first portion of the cooled feed air and the second portion of the cooled feed air are combined and passed together into the cryogenic air separation plant.

7. Cryogenic air separation apparatus comprising:

(A) a main heat exchanger and a cryogenic air separation plant comprising at least one column;

(B) means for passing feed air upwardly through a first section of the main heat exchanger, and means for passing feed air downwardly through a second section of the main heat exchanger;

(C) means for passing feed air from the main heat exchanger to the cryogenic air separation plant; and (D) means for passing product from the cryogenic air separation plant to the main heat exchanger, and means for recovering product from the, main heat exchanger.

8. The apparatus of claim 7 wherein the cryogenic air separation plant comprises a single column and a top condenser.

9. The apparatus of claim 8 wherein the means for passing product from the cryogenic air separation plant to the main heat exchanger communicates with the upper portion of the single column.

10. The apparatus of claim 8 further comprising a turboexpander, means for passing fluid from the top condenser to the turboexpander, and means for passing fluid from the turboexpander to the main heat exchanger.

* * * * *